US007845059B2

(12) United States Patent
Lockwood et al.

(10) Patent No.: US 7,845,059 B2
(45) Date of Patent: Dec. 7, 2010

(54) METHOD OF FORMING IMPREGNATED DIAMOND CUTTING STRUCTURES

(75) Inventors: Gregory T. Lockwood, Pearland, TX (US); Thomas W. Oldham, The Woodlands, TX (US); Anthony Griffo, The Woodlands, TX (US); Madapusi K. Keshavan, The Woodlands, TX (US); David A. Conroy, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 367 days.

(21) Appl. No.: 12/021,131

(22) Filed: Jan. 28, 2008

(65) Prior Publication Data

US 2008/0128951 A1 Jun. 5, 2008

Related U.S. Application Data

(62) Division of application No. 10/967,651, filed on Oct. 18, 2004, now Pat. No. 7,350,599.

(51) Int. Cl.
*B23P 25/00* (2006.01)
*B22F 3/12* (2006.01)

(52) U.S. Cl. ..... 29/458; 264/332

(58) Field of Classification Search ..... 29/447, 29/428, 460, 458; 264/332; 419/32; 175/374, 175/433, 434

See application file for complete search history.

(56) References Cited

U.S. PATENT DOCUMENTS

| | | | | |
|---|---|---|---|---|
| 4,723,996 | A | 2/1988 | Brunet et al. | |
| 4,797,241 | A | 1/1989 | Peterson et al. | |
| 5,089,182 | A | 2/1992 | Findeisen et al. | |
| 5,598,621 | A | 2/1997 | Littecke et al. | |
| 5,676,496 | A | 10/1997 | Littecke et al. | |
| 5,755,298 | A | 5/1998 | Langford, Jr. et al. | |
| 5,889,219 | A | 3/1999 | Moriguchi et al. | |
| 6,095,265 | A | 8/2000 | Alsup | |
| 6,170,583 | B1 | 1/2001 | Boyce | |
| 6,238,280 | B1 | 5/2001 | Ritt et al. | |
| 6,319,460 | B1 * | 11/2001 | Fang | 419/32 |

(Continued)

FOREIGN PATENT DOCUMENTS

| | | |
|---|---|---|
| CA | 2594037 | 11/2008 |

(Continued)

OTHER PUBLICATIONS

Office Action for Application No. GB0714147.6, mailed on Dec. 4, 2009 (3 pages).

(Continued)

*Primary Examiner*—John C Hong
(74) *Attorney, Agent, or Firm*—Osha • Liang LLP

(57) ABSTRACT

An insert for a drill bit that includes diamond particles disposed in a matrix material, wherein the diamond particles have a contiguity of 15% or less is disclosed. A method of forming a diamond-impregnated cutting structure, that includes loading a plurality of substantially uniformly coated diamond particles into a mold cavity, pre-compacting the substantially uniformly coated diamond particles using a cold-press cycle, and heating the compacted, substantially uniformly coated diamond particles with a matrix material to form the diamond impregnated cutting structure is also disclosed.

20 Claims, 5 Drawing Sheets

U.S. PATENT DOCUMENTS

| | | | | |
|---|---|---|---|---|
| 6,394,202 | B2 | 5/2002 | Truax et al. | |
| 6,454,027 | B1 | 9/2002 | Fang et al. | |
| 6,610,113 | B1 * | 8/2003 | Mehrotra et al. | 51/308 |
| 6,742,611 | B1 | 6/2004 | Illerhaus et al. | |
| 7,350,599 | B2 | 4/2008 | Lockwood et al. | |
| 2006/0081402 | A1 | 4/2006 | Lockwood et al. | |
| 2006/0162967 | A1 | 7/2006 | Brackin et al. | |
| 2006/0213128 | A1 | 9/2006 | Sung | |
| 2008/0128951 | A1 | 6/2008 | Lockwood et al. | |
| 2008/0202821 | A1 | 8/2008 | McClain et al. | |
| 2008/0282618 | A1 | 11/2008 | Lockwood | |
| 2009/0120008 | A1 | 5/2009 | Lockwood et al. | |

FOREIGN PATENT DOCUMENTS

| | | | |
|---|---|---|---|
| DE | 102005048687 | | 5/2006 |
| EP | 0046374 | | 2/1982 |
| GB | 2362655 | | 11/2001 |
| GB | 2405413 | | 3/2005 |
| GB | 2440438 | | 1/2008 |
| GB | 2450177 | | 12/2008 |
| GB | 2454589 | | 5/2009 |
| RU | 2216435 | | 11/2003 |
| WO | 99/36590 | | 7/1999 |
| WO | 9936658 | | 7/1999 |
| WO | 0123630 | | 4/2001 |
| WO | 2004/029310 | A2 | 4/2004 |
| WO | 2006/063136 | | 6/2006 |
| WO | 2008/103417 | | 8/2008 |

OTHER PUBLICATIONS

U.S. Office Action for Utility U.S. Appl. No. 11/779,083, mailed on Nov. 18, 2009 (11 pages).

German Final Office Action for related Application No. 102005048687.8, dated Mar. 16, 2009 (10 pages).

Combined Search and Examination Report dated Nov. 20, 2007, issued in GB Application No. 0714150.0 (8 pages).

Canadian Office Action for related Application 2,594,037 dated Sep. 2, 2009 (3 pages).

Combined Search and Examination Report for United Kingdom Application No. 1005530.9, mailed on Apr. 22, 2010 (4 pages).

Response to Final Office Action dated Feb. 18, 2010, for U.S. Appl. No. 11/779,083 (11 pages).

U.S. Office Action for Utility U.S. Appl. No. 11/779,083, mailed on Mar. 4, 2010 (9 pages).

Response to Examination Report dated Dec. 7, 2009, to Examination Report dated Aug. 6, 2009, for corresponding application GB0714150.0 (17 pages).

Examination Report for United Kingdom Application No. 0714150.0, mailed Aug. 6, 2009 (9 pages).

Response to Examination Report dated Jun. 23, 2009, to Examination Report dated Jul. 29, 2008, for corresponding application GB0714150.0 (7 pages).

Response to Office Action filed Oct. 30, 2009, in response to the Official Action dated Apr. 30, 2009, in Canadian Application No. 2,593,951 (25 pages).

Combined Search and Examination Report for United Kingdom Application No. 0820485.1, mailed on Jan. 6, 2009 (7 pages).

Examination Report for United Kingdom Application No. 0820485.1, mailed on Feb. 1, 2010 (1 page).

Response to Examination Report filed Sep. 18, 2009, in response to the Examination Report dated Dec. 5, 2007, for United Kingdom Application No. 0714147.6 (21 pages).

Combined Search and Examination Report for United Kingdom Application No. 0714147.6, mailed on Dec. 5, 2007 (5 pages).

Examination Report for United Kingdom Application No. 0714147.6, mailed on Dec. 4, 2009 (2 pages).

Canadian Office Action for Canadian Application No. 2,594,037, mailed on Sep. 2, 2009 (3 pages).

* cited by examiner

METHOD OF FORMING IMPREGNATED DIAMOND CUTTING STRUCTURES

This application claims the benefit, pursuant to 35 U.S.C. §120, to U.S. patent application Ser. No. 10/967,651, filed on Oct. 18, 2004, which is herein incorporated by reference by its entirety.

BACKGROUND OF INVENTION

1. Field of the Invention

The present invention relates generally to drill bits used in the oil and gas industry and more particularly, to drill bits having diamond-impregnated cutting surfaces. Still more particularly, the present invention relates to drag bits in which the diamond particles imbedded in the cutting surface are substantially uniformly coated with matrix to improve diamond retention and wear life.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earthen formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

During abrasive drilling with a diamond-impregnated cutting structure, the diamond particles scour or abrade away concentric grooves while the rock formation adjacent the grooves is fractured and removed. As the matrix material around the diamond granules is worn away, the diamonds at the surface eventually fall out and other diamond particles are exposed.

An example of a prior art diamond impregnated drill bit ("impreg bit") is shown in FIG. 1. The drill bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Impreg bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In one impreg bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. One method for forming such a bit structure is disclosed in U.S. Pat. No. 6,394,202 (the '202 patent), which is assigned to the assignee of the present invention and is hereby incorporated by reference.

Referring now to FIG. 2, a drill bit 20 in accordance with the '202 patent comprises a shank 24 and a crown 26. Shank 24 is typically formed of steel and includes a threaded pin 28 for attachment to a drill string. Crown 26 has a cutting face 22 and outer side surface 30. According to one embodiment, crown 26 is formed by infiltrating a mass of tungsten-carbide powder impregnated with synthetic or natural diamond, as described above.

Crown 26 may include various surface features, such as raised ridges 27. Preferably, formers are included during the manufacturing process so that the infiltrated, diamond-impregnated crown includes a plurality of holes or sockets 29 that are sized and shaped to receive a corresponding plurality of diamond-impregnated inserts 10. Once crown 26 is formed, inserts 10 are mounted in the sockets 29 and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 29 can be inclined with respect to the surface of the crown 26. In this embodiment, the sockets are inclined such that inserts 10 are oriented substantially in the direction of rotation of the bit, so as to enhance cutting.

As a result of the manufacturing technique of the '202 patent, each diamond-impregnated insert is subjected to a total thermal exposure that is significantly reduced as compared to previously known techniques for manufacturing infiltrated diamond-impregnated bits. For example, diamonds imbedded according to methods disclosed in the '202 patent have a total thermal exposure of less than 40 minutes, and more typically less than 20 minutes (and more generally about 5 minutes), above 1500° F. This limited thermal exposure is due to the shortened hot pressing period and the use of the brazing process.

The total thermal exposure of methods disclosed in the '202 patent compares very favorably with the total thermal exposure of at least about 45 minutes, and more typically about 60-120 minutes, at temperatures above 1500° F., that occurs in conventional manufacturing of furnace-infiltrated, diamond-impregnated bits. If diamond-impregnated inserts are affixed to the bit body by adhesive or by mechanical means such as interference fit, the total thermal exposure of the diamonds is even less.

With respect to the diamond material to be incorporated (either as an insert, or on the bit, or both), diamond granules are formed by mixing diamonds with matrix power and binder into a paste. The paste is then extruded into short "sausages" that are rolled and dried into irregular granules. The process for making diamond-impregnated matrix for bit bodies involves hand mixing of matrix powder with diamonds and a binder to make a paste. The paste is then packed into the desired areas of a mold. The resultant irregular diamond distribution has clusters with too many diamonds, while other areas are void of diamonds. The diamond clusters lack sufficient matrix material around them for good diamond retention. The areas void or low in diamond concentration have poor wear properties. Accordingly, the bit or insert may fail prematurely, due to uneven wear. As the motors or turbines powering the bit improve (higher sustained RPM), and as the drilling conditions become more demanding, the durability of diamond-impregnated bits needs to improve. What is still needed, therefore, are techniques for improving the diamond distribution in impregnated cutting structures.

SUMMARY OF INVENTION

In one aspect, the present invention relates to an insert for a drill bit that includes diamond particles disposed in a matrix material, wherein the diamond particles have a contiguity of 15% or less.

In another aspect, the present invention relates to a method of forming a diamond-impregnated cutting structure, that includes loading a plurality of substantially uniformly coated diamond particles into a mold cavity, pre-compacting the substantially uniformly coated diamond particles using a cold-press cycle, and heating the compacted, substantially uniformly coated diamond particles with a matrix material to form the diamond impregnated cutting structure.

Other aspects and advantages of the invention will be apparent from the following description and the appended claims.

DETAILED DESCRIPTION

Figure 1:
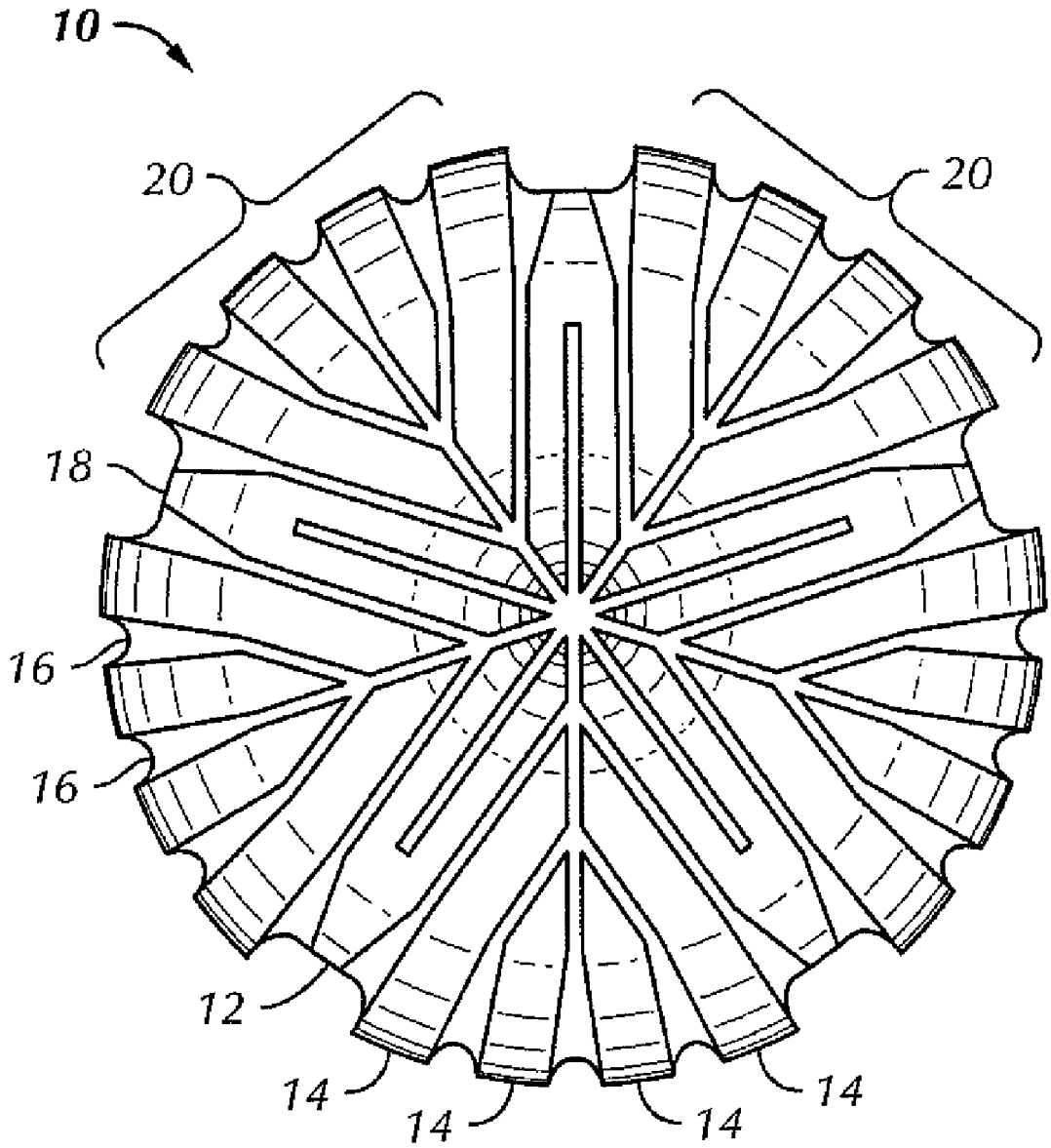
FIG. 1 (Prior Art)
FIG. 1 shows a prior art impreg bit.

In one aspect, the present invention relates to impregnated cutting structures that have a more "even" distribution of diamond. As used herein, the term "even" distribution simply means that the diamond particles are more uniformly distributed throughout the impregnated structure when compared with similar prior art samples.

The relative distribution of diamond may be measured using several different methods. First, the distribution may be discussed in terms of diamond "contiguity," which is a measure of the number of diamonds that are in direct contact with another diamond. Ideally, if complete distribution existed, the diamond to diamond contiguity would be 0% (i.e., no two diamonds are in direct contact). By contrast, analysis of typical currently used impregnated cutting structures has revealed a diamond contiguity of approximately 50% (i.e., approximately half of the diamonds are in contact with other diamonds).

The diamond contiguity may be determined as follows:

$$C_{D\text{-}D}=(2P_{D\text{-}D})/(2P_{D\text{-}D}+P_{D\text{-}M}) \quad \text{(Eq. 1)}$$

where $P_{D\text{-}D}$ equals the total number of contiguous points of diamond along the horizontal lines of a grid placed over a sample photo, and $P_{D\text{-}M}$ equals the total number of points where diamonds contact matrix.

Second, the diamond distribution may be discussed in terms of the mean free path, which represents the mean distance between diamond particles. Using this metric, the larger the mean free path (for a given diamond concentration) the more evenly distributed the diamonds are.

Certain embodiments of the present invention relate to using "uniformly" coated diamond particles. As used herein, the term "uniformly coated" means that that individual diamond particles have similar amounts of coating (i.e., they have relatively the same size), in approximately the same shape (e.g. spherical coating), and that single diamond crystals are coated rather than diamond clusters. The term "uniformly" is not intended to mean that all the particles have the exact same size or exact same amount of coating, but simply that when compared to prior art coated crystals, they are substantially more uniform. The present inventors have discovered that by using diamond particles having a uniform matrix powder coating over each diamond crystal provides consistent spacing between the diamonds in the finished parts.

Thus, advantageously, certain embodiments of the present invention, by creating impregnated structures having more uniform distribution results in products having more uniform wear properties, improved diamond retention, and increased diamond concentration for a given volume, when compared to prior art structures. In addition, coating uniformity permits the use of minimal coating thickness, thus allowing an increased diamond concentration to be used.

Embodiments of the present invention decrease the likelihood of diamond fracture (due to clustering—i.e., due to diamond particles being clustered and having insufficient matrix powder to hold them in place) and improves composite sinterability. Furthermore, embodiments of the present invention facilitate the use of ultrafine bond powders (<3 μm WC) allowing increased hardness to be achieved (>60 HRc). The increased hardness in ultrafine powders is due to the lack of void space when compared to coarser powders. In addition, embodiments of the present invention allow diamond volume to be increased by optimizing selected properties such as particle size, diamond grit size and diamond concentration.

In selected embodiments, diamond granules have a substantially uniform matrix layer around each crystal and provide a substantially consistent spacing between the diamonds. This prevents diamond contiguity and provides adequate matrix around each crystal to assure good diamond retention. Uniform diamond distribution permits high diamond concentration without risk of contiguity, and provides for consistent wear life.

In one embodiment of the invention, uniformly coated diamonds are manufactured prior to the formation of the impregnated bit. An exemplary method for achieving "uniform coatings" is to mix the diamonds, matrix powder and an organic binder in a commercial mixing machine such as a Turbula Mixer or similar machine used for blending diamonds with matrix. The resultant mix is then be processed through a "granulator" in which the mix is extruded into short "sausage" shapes which are then rolled into balls and dried. The granules that are so formed must be separated using a series of mesh screens in order to obtain the desired yield of uniformly coated crystals. At the end of this process, a number of particles of approximately the same size and shape can be collected. Another exemplary method for achieving a uniform matrix coating on the crystals is to use a machine called a Fuji Paudal pelletizing machine. Alternatively, diamond particles suitable for use in embodiments of the present invention may be purchased from Foxmet SA located in Luxembourg, or from Lunzer Inc., located in New Jersey, USA. These vendors sell diamond particles that are uniformly surrounded by matrix powder.

Figure 3:
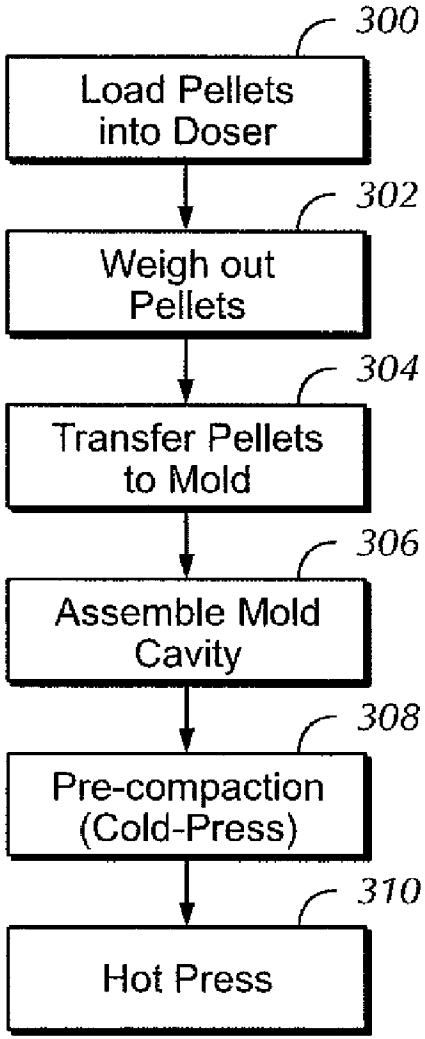
FIG. 3 is a flow chart illustrating a manufacturing method in accordance with an embodiment of the present invention.

FIG. 3 illustrates a method of manufacturing an impregnated cutting structure in accordance with an embodiment of the present invention. First, the uniformly coated diamond particles (or pellets), which are surrounded by matrix powder, are loaded (Step 300) into a doser. The doser weighs out (Step 302) the amount of the uniformly coated diamond pellets going into a mold. The pellets are then transferred into a mold cavity (Step 304). After the diamond pellets have been transferred to the mold cavity, the mold is assembled (Step 306). The pellets are then subjected to a pre-compaction step, using a cold press stage (Step 308). The contents are then hot-pressed or sintered at an appropriate temperature (Step 310), preferably between about 1500 and about 2200° F., more preferably between about 1800° F. and about 2100° F., to form an insert or coated bit body. While embodiments of the invention may be used to manufacture an insert or an impreg bit, for clarity, the following description is focused on the formation of an insert.

In one specific embodiment, for example, 27.01 g of uniformly coated diamond particles were loaded into the doser. The particles were then transferred into a mold cavity, suitable for forming a 13 mm diameter insert. Typically, 25 inserts of this size may be pressed at a single time. After undergoing the cold-press and hot-press processes described above, the diamond contiguity of the newly formed inserts was measured on a fractured cross-section. In this particular embodiment, the average diamond contiguity measured two percent. In other embodiments, diamond contiguity of between 0%-15% may be present. In certain embodiments, 0%-10% diamond contiguity is found. In still other embodiments, diamond contiguity of 0%-5% is found. The volume percent of diamond in certain embodiments using these uniformly coated diamond particles was 27.5%, which corresponds to 110 diamond concentration.

One of ordinary skill in the art would appreciate that the coated diamond of the invention may also be used to form bit bodies using any suitable method known in the art. Heating of the material can be by furnace or by electric induction heating, such that the heating and cooling rates are rapid and controlled in order to prevent damage to the diamonds. The inserts may be heated by resistance heating in a graphite mold. The dimensions and shapes of the inserts and of their positioning on the bit can be varied, depending on the nature of the formation to be drilled.

The matrix in which the coated diamonds are embedded to form the coated diamond impregnated inserts preferably satisfies several requirements. The matrix preferably has sufficient hardness so that the diamonds exposed at the cutting face are not pushed into the matrix material under the very high pressures encountered in drilling. In addition, the matrix preferably has sufficient abrasion resistance so that the diamond particles are not prematurely released. Lastly, the heating and cooling time during sintering or hot-pressing, as well as the maximum temperature of the thermal cycle, preferably are sufficiently low that the diamonds embedded therein are not thermally damaged during sintering or hot-pressing.

Prior art coatings on diamonds, to the extent that they were known, involve chemical vapor deposition (CVD), typically silicon or titanium carbide, in which a material is deposited on the diamond in a thickness of only a few micrometers. This is in contrast to the present invention, in which coatings of typically greater than 200 micrometers are used. In certain embodiments, thicknesses of approximately 400 micrometers may be used. However, combinations of the prior art coating (e.g., titanium carbide deposited using CVD) and the coating of embodiments of the present invention (e.g., tungsten carbide/cobalt/copper/polymer binder) may be used in conjunction (i.e., particles having a titanium carbide coating may be subsequently coated with matrix material (as an outer coating)).

In certain embodiments, the "interior" coating (TiC in the above example) may help bond the diamond to the "outer" matrix coating. Additionally, in certain applications the interior coating may reduce thermal damage to the particles.

To satisfy these requirements, as an exemplary list, the following materials may be used for the matrix in which the coated diamonds are embedded: tungsten carbide (WC), tungsten (W), sintered tungsten carbide/cobalt (WC—Co) (spherical or crushed), cast tungsten carbide (spherical or crushed) or combinations of these materials (all with an appropriate binder phase such as cobalt, iron, nickel, or copper to facilitate bonding of particles and diamonds), and the like. The base metals are usually doped with lower melting temperature elements in order to hot press at lower temperatures. Those of ordinary skill in the art will recognize that other materials may also be used for the matrix, including titanium-based compounds, nitrides (in particular cubic boron nitride), etc.

It will further be understood that the concentration of diamond in the inserts can differ from the concentration of diamond in the bit body. It should be noted that combinations of coated and uncoated diamonds may be used, depending on the particular application. According to one embodiment, the concentrations of diamond in the inserts and in the bit body are in the range of 50 to 150 (100=4.4 carat/$cm^3$). A diamond concentration of 100 is equivalent to 25% by volume diamond. Those having ordinary skill in the art will recognize that other concentrations of diamonds may also be used depending on particular applications.

Further, while reference has been made to a hot-pressing process above, embodiments of the present invention may use a high-temperature, high-pressure press (HTHP) process. Alternatively, a two-stage manufacturing technique, using both the hot-pressing and the HTHP, may be used to promote the development of high concentration (>120 conc.) while achieving maximum bond or matrix density. The HTHP press can improve the performance of the final structure by enabling the use of higher diamond volume percent (including bi-modal or multi-modal diamond mixtures) because ultrahigh pressures can consolidate the bond material to near full density (with or without the need for low-melting alloys to aid sintering).

The HTHP process has been described in U.S. Pat. No. 5,676,496 and U.S. Pat. No. 5,598,621, and their teachings are incorporated by reference herein. Another suitable method for hot-compacting pre-pressed diamond/metal powder mixtures is hot isostatic pressing, which is known in the art. See Peter E. Price and Steven P. Kohler, "Hot Isostatic Pressing of Metal Powders", *Metals Handbook*, Vol. 7, pp. 419-443 (9th ed. 1984).

Figure 4:
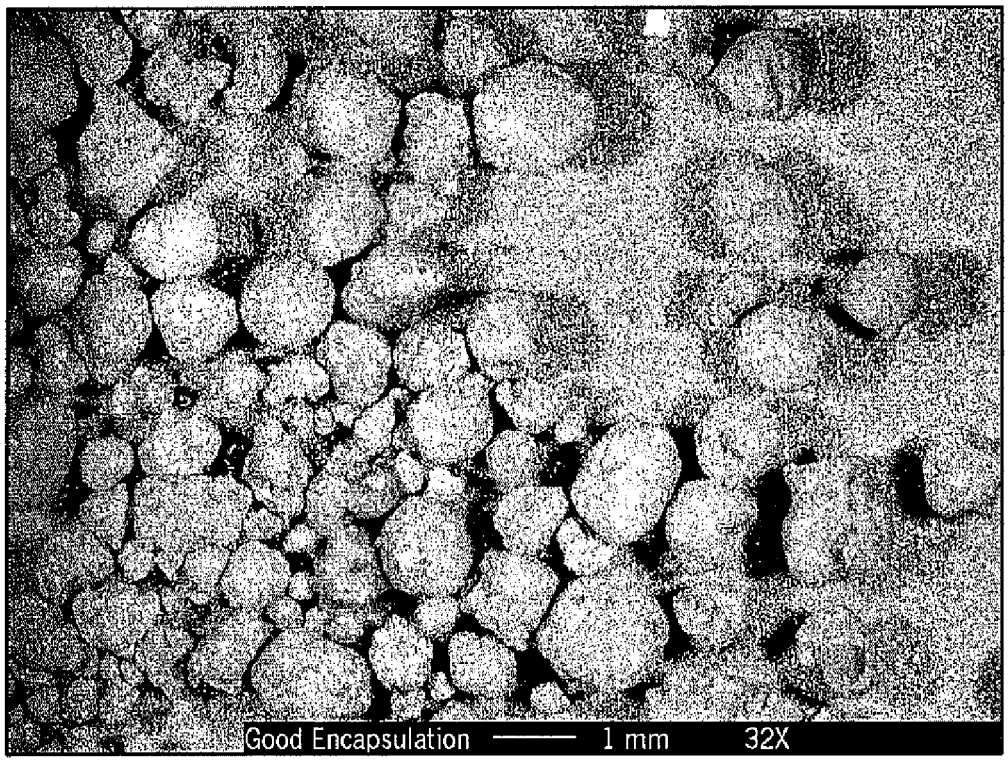
FIG. 4 is a photograph showing prior art coated particles.

FIGS. 4-7 illustrate the improved distribution of diamonds that can be achieved by using uniformly coated diamonds in conjunction with various manufacturing techniques. FIG. 4 shows a photograph (32× magnification) of typical prior art coated pellets, as viewed before pressing into a part. As can be seen from the photograph, the coated diamonds vary widely in size and shape. Moreover, it is apparent that certain of the pellets encapsulate multiple diamond crystals, while other pellets contain no diamond crystals at all.

Figure 5:
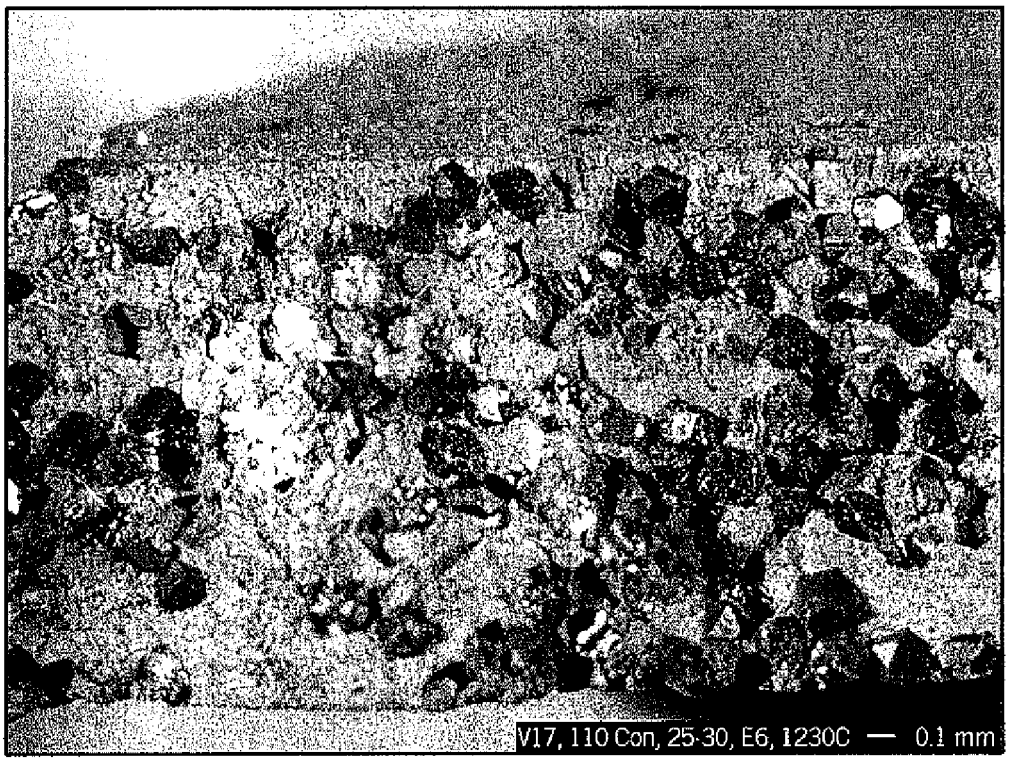
FIG. 5 is a photograph showing a disc made of the particles of FIG. 4.

FIG. 5 shows a photograph of the diamond distribution that results from using the particles of FIG. 4, using the manufacturing techniques described above. In particular, FIG. 5 is a sample disc created at 110 concentration that contains nominally 25-30 mesh diamond particles. FIG. 5 reveals significant amounts of diamond "clustering." That is, there exist small regions that have significantly more diamonds than other regions. For example, the upper right side of the disc contains significantly more diamonds than the lower left side of the disc. As explained above, such discrepancies in diamond distribution may lead to early failure. Significantly, and counter-intuitively, the region with the high diamond concentration may fail first, because insufficient matrix exists to hold the diamond clusters in place. This result is counter-intuitive because it would seem that the higher the diamond concentration, the more wear resistant the sample would become. However, testing has revealed that diamond clusters such as the ones shown in FIG. 5, will break off rather readily. Another problem with diamond clusters is that clusters provide an easy path for crack propagation throughout the insert, leading to lower impact and fracture toughness for a given volume percent of diamond.

Figure 6:
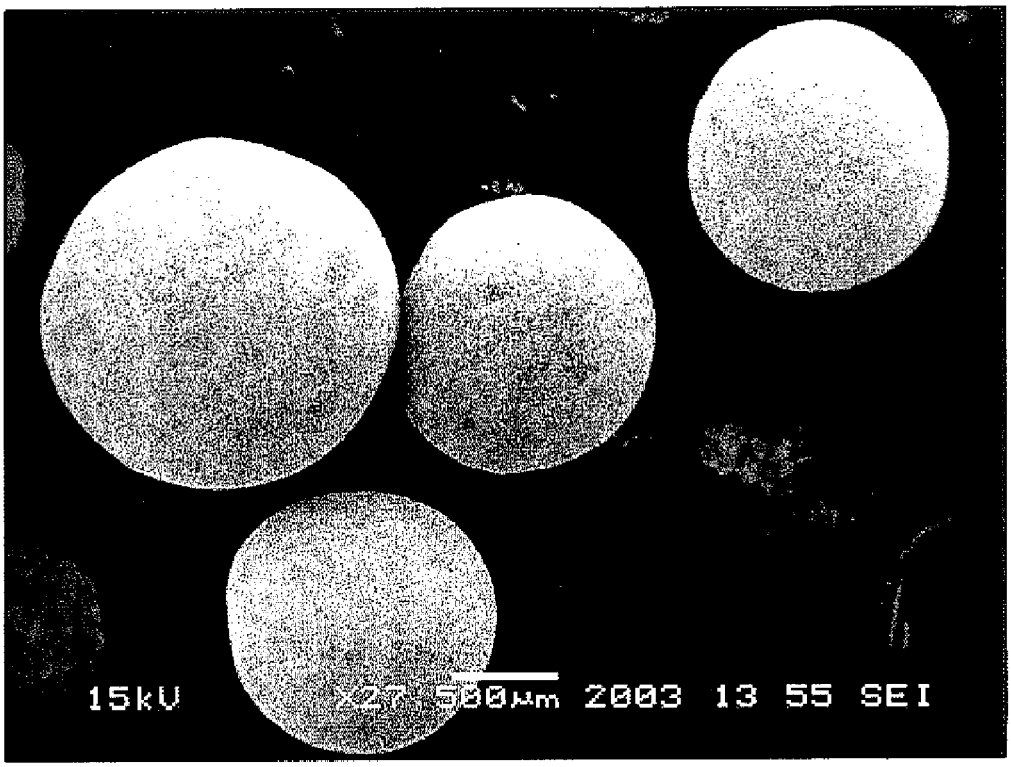
FIG. 6 is a photograph showing the uniformly coated particles in accordance with an embodiment of the present invention.

Turning to FIG. 6, a photograph of the uniformly coated pellets is shown. The pellets in this picture are approximately the same shape and size. While the pellets are shown as spheres of approximately the same size and shape, the present invention is not so limited. The uniformly coated diamonds may comprise other shapes, such as ellipses, rectangles, squares, or non-regular geometries, or mixtures of the shapes, so long as they are approximately the same shape and size. Mixture of the shapes may be used, so long as the coating is thick enough to ensure no diamond to diamond contact. Further, bi-modal or multi-modal mixtures of pellets may be chosen to increase diamond density. In certain embodiments, mixtures of pellet sizes are used to allow for higher amounts of diamond to be incorporated into the structure, while maintaining suitable diamond contiguity.

Figure 7:
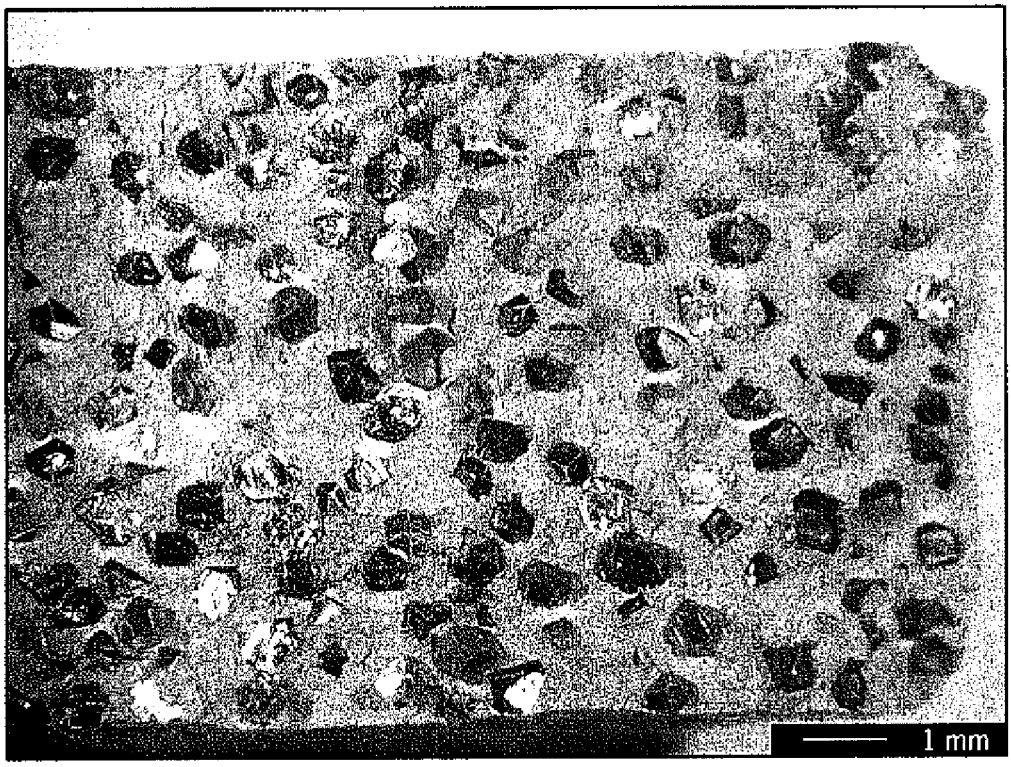
FIG. 7 is a photograph showing a disc made of the particles of FIG. 6.

FIG. 7 shows a photograph of the diamond distribution that results from using the particles of FIG. 6, using the manufacturing techniques described above. In particular, FIG. 7 is a sample disc created at 110 concentration that contains nominally 25-35 mesh diamond particles. When compared to the sample shown in FIG. 5, it is apparent that the use of uniformly coated particles results in a much more even distribution of the diamond throughout the disc. Clusters of diamond are not present in this sample, leading to a larger mean free path between the diamonds, and a substantially lower diamond contiguity value as compared to those in FIG. 5.

Figure 8:
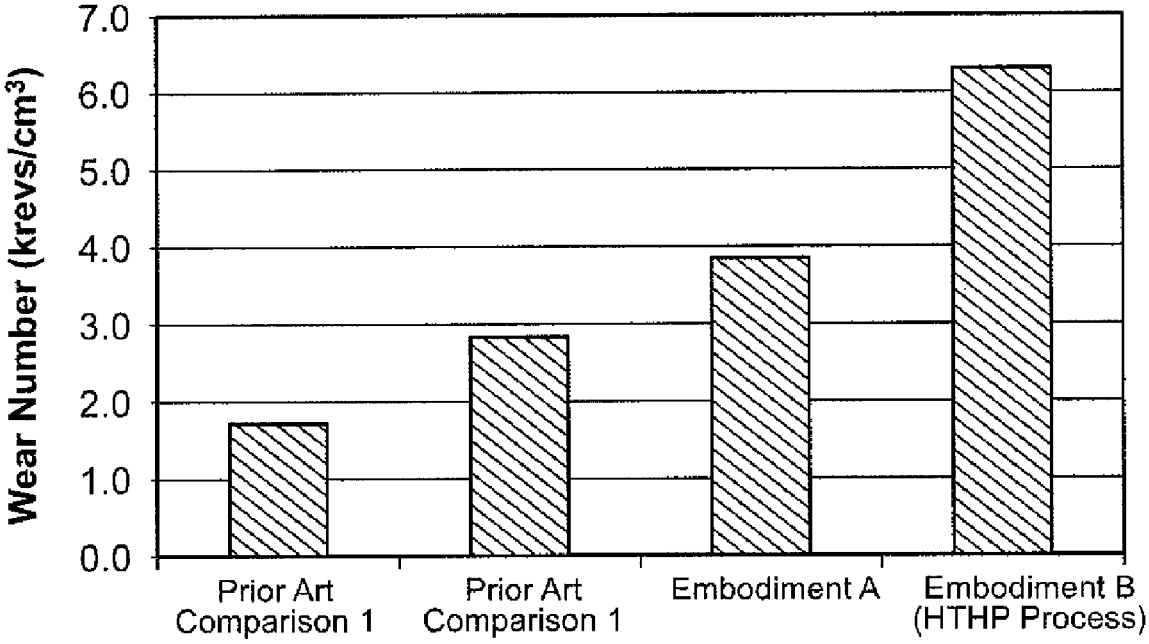
FIG. 8 is a graph showing the performance of discs made in accordance with embodiments of the present invention against prior art discs.

Initial wear tests of discs manufactured according to the above process have indicated that performance may be improved by using the methods described above. Examination of the wear scars at 10× showed a much improved diamond retention in the matrix, leading to an improved wear resistance. FIG. 8 illustrates the relative wear performance of two prior art discs against two embodiments of the present invention. In FIG. 8, the performance of tungsten carbide composites having 27.5% by volume diamond (25-35 mesh) was compared. Prior art comparison 1 (800) is a disc formed from a standard impregnated rib matrix containing non-uniformly coated diamonds. Prior art comparison 2 (802) is a disc formed using a hot press process, with non-uniformly coated diamonds. Embodiment A (804) is a disc formed using a hot press process, with substantially uniformly coated diamonds in accordance with embodiments of the present invention. Embodiment B (806) is a disc formed using a high-temperature, high-pressure process, with substantially uniformly coated diamonds in accordance with embodiments of the present invention. FIG. 8 illustrates the substantially improved abrasion resistance that may be achieved by using embodiments of the present invention.

It will be understood that the materials commonly used for construction of bit bodies can be used in the present invention. Hence, in one embodiment, the bit body may itself be diamond-impregnated. In an alternative embodiment, the bit body comprises infiltrated tungsten carbide matrix that does not include diamond.

In an alternative embodiment, the bit body can be made of steel, according to techniques that are known in the art. Again, the final bit body includes a plurality of holes having a desired orientation, which are sized to receive and support the inserts. The inserts, which include coated diamond particles, may be affixed to the steel body by brazing, mechanical means, adhesive or the like.

Figure 2:
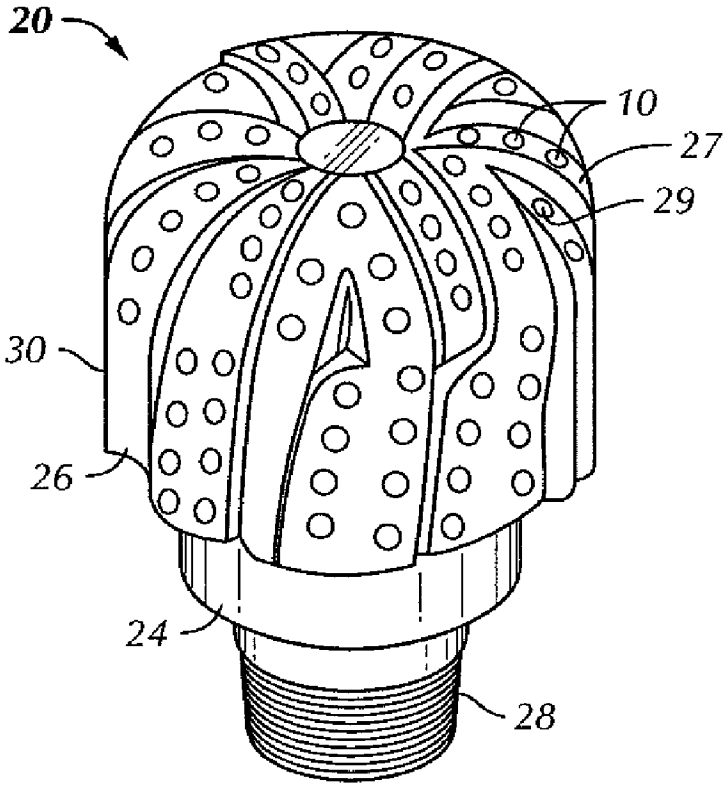
FIG. 2 (Prior Art)
FIG. 2 is a prior art perspective view of a second type of impreg bit.

Referring again to FIG. 2, impreg bits may include a plurality of gage protection elements disposed on the ribs and/or the bit body. In some embodiments of the present invention, the gage protection elements may be modified to include evenly distributed diamonds. By positioning evenly distributed diamond particles at and/or beneath the surface of the ribs, the impreg bits are believed to exhibit increased durability and are less likely to exhibit premature wear than typical prior art impreg bits.

Embodiments of the present invention, therefore, may find use in any bit application in which diamond impregnated materials may be used. Specifically, embodiments of the present invention may be used to create diamond impregnated inserts, diamond impregnated bit bodies, diamond impregnated wear pads, or any other diamond impregnated material known to those of ordinary skill in the art. Embodiments of the present invention may find use as inserts or wear pads for 3-cone, 2-cone, and 1-cone (1-cone with a bearing & seal) drill bits. Further, while reference has been made to spherical particles, it will be understood by those having ordinary skill in the art that other particles and/or techniques may be used in order to achieve the desired result, namely more even distribution of diamond particles. For example, it is expressly within the scope of the present invention that elliptically coated particles may be used.

Furthermore, while the above embodiments describe "coated diamonds," it is expressly within the scope of the present invention that other abrasive materials may be coated in a similar fashion. In particular, boron nitride particles can be similarly coated and used in the various bit applications described herein. In addition, the term "diamond" as used herein, is intended to include larger particles of polycrystalline diamond and thermally stable polycrystalline diamond particles (TSP), which may be similarly coated as are the individual diamond particles.

Those having ordinary skill in the art will appreciate that in other embodiments of the present invention, thermally stable polycrystalline diamond particles in the shape of cubes, irregular shapes, or other shapes may be coated with matrix in a manner similar to the processes described above. These coated TSP particles may then be used as impreg pellets, for example.

As discussed above, embodiments of the present invention may provide uniform and improved wear properties, improved diamond retention, and increased diamond concentration for a given volume. The diamond used in embodiments of the present invention may be synthetic or natural diamond.

While the invention has been described with respect to a limited number of embodiments, those skilled in the art, having benefit of this disclosure, will appreciate that other embodiments can be devised which do not depart from the scope of the invention as disclosed herein. In particular, other methods may be used to achieve diamond contiguities disclosed by the present application, which do not deviate from the scope of the present invention. Accordingly, the scope of the invention should be limited only by the attached claims.

What is claimed is:

1. A method of forming a diamond-impregnated cutting structure, comprising:

loading a plurality of diamond particles being substantially uniformly coated with a matrix powder material into a mold cavity;

pre-compacting the substantially uniformly coated diamond particles using a cold-press cycle; and heating the compacted, substantially uniformly coated diamond particles to form the diamond impregnated cutting structure.

2. The method of claim 1, wherein the matrix material is selected from tungsten carbide (WC), cast tungsten carbide, elemental tungsten (W), sintered tungsten carbide-cobalt (WC-Co), titanium-based compounds, nitrides and combinations of these materials.

3. The method of claim 1, wherein said heating step comprises a hot-pressing process.

4. The method of claim 3, wherein the heating step is performed at a temperature between 1500° F. and 2200° F.

5. The method of claim 4, wherein the heating step is performed at a temperature of between 1800° F. and 2100° F.

6. The method of claim 1, wherein the heating step comprises a high-pressure, high-temperature process.

7. The method of claim 1, wherein the heating step comprises hot isostatic pressing.

8. The method of claim 1, wherein the diamond-impregnated cutting structure comprises an insert.

9. The method of claim 1, wherein the diamond-impregnated cutting structure comprises a diamond-impregnated bit.

10. The method of claim 1, wherein the heating step comprises a hot-pressing process, and further comprises a high-pressure, high-temperature process, subsequent to the heating step.

11. A method of forming a diamond-impregnated cutting structure, comprising:

loading a plurality of diamond particles being substantially uniformly coated with a matrix powder material into a mold cavity;

heating and compacting the substantially uniformly coated diamond particles to form a diamond impregnated insert; and affixing the diamond impregnated insert to a drill bit body.

12. The method of claim 11, wherein the matrix material is selected from tungsten carbide (WC), cast tungsten carbide, elemental tungsten (W), sintered tungsten carbide-cobalt (WC-Co), titanium-based compounds, nitrides and combinations of these materials.

13. The method of claim 11, wherein said heating step comprises a hot-pressing process.

14. The method of claim 11, wherein the heating step comprises a high-pressure, high-temperature process.

15. The method of claim 11, wherein the heating step comprises hot isostatic pressing.

16. The method of claim 15, further comprising:

affixing the insert to a drill bit body.

17. The method of claim 11, further comprising:

coating a plurality of diamond particles with a substantially uniform coating of matrix powder material.

18. A method of forming a diamond-impregnated cutting structure, comprising:

loading a plurality of diamond particles being substantially uniformly coated with a matrix powder material into a mold cavity; and heating the substantially uniformly coated diamond particles to form the diamond impregnated cutting structure.

19. The method of claim 13, wherein the matrix material is selected from tungsten carbide (WC), cast tungsten carbide, elemental tungsten (W), sintered tungsten carbide-cobalt (WC-Co), titanium-based compounds, nitrides and combinations of these materials.

20. The method of claim 13, wherein the diamond impregnated cutting structure is an insert.

* * * * *